US011519622B2

(12) United States Patent
Blincoe et al.

(10) Patent No.: US 11,519,622 B2
(45) Date of Patent: Dec. 6, 2022

(54) HVAC MONITORING SYSTEM

(71) Applicants: Rodney Craig Blincoe, Highlands Ranch, CO (US); Adam Roller, Golden, CO (US); Kathryn Huonder, Erie, CO (US); Tariq Al Salmani, Lakewood, CO (US)

(72) Inventors: Rodney Craig Blincoe, Highlands Ranch, CO (US); Adam Roller, Golden, CO (US); Kathryn Huonder, Erie, CO (US); Tariq Al Salmani, Lakewood, CO (US)

( * ) Notice: Subject to any disclaimer, the term of this patent is extended or adjusted under 35 U.S.C. 154(b) by 0 days.

(21) Appl. No.: 17/585,583

(22) Filed: Jan. 27, 2022

(65) Prior Publication Data

US 2022/0243942 A1 Aug. 4, 2022

Related U.S. Application Data

(60) Provisional application No. 63/224,761, filed on Jul. 22, 2021, provisional application No. 63/143,040, filed on Jan. 29, 2021.

(51) Int. Cl.

| | |
|---|---|
| ***F24F 11/38*** | (2018.01) |
| ***F24F 11/88*** | (2018.01) |
| ***F24F 11/56*** | (2018.01) |
| ***F24F 11/33*** | (2018.01) |
| ***F24F 11/526*** | (2018.01) |
| ***F24F 11/61*** | (2018.01) |
| ***F24F 11/89*** | (2018.01) |

(52) U.S. Cl.
CPC ..... *F24F 11/38* (2018.01); *F24F 11/33* (2018.01); *F24F 11/526* (2018.01); *F24F 11/56* (2018.01); *F24F 11/61* (2018.01); *F24F 11/88* (2018.01); *F24F 11/89* (2018.01)

(58) Field of Classification Search
CPC .. F24F 11/61; F24F 11/56; F24F 11/89; F24F 11/33; F24F 11/88; F24F 11/526; F24F 11/38
See application file for complete search history.

(56) References Cited

U.S. PATENT DOCUMENTS 3,202,209 A * 8/1965 Otto ..... F24F 5/0007 165/286
4,687,050 A * 8/1987 Podlipnik ..... G05D 23/1928 236/1 C (Continued)

*Primary Examiner* — Nelson J Nieves
(74) *Attorney, Agent, or Firm* — Roger A. Jackson

(57) ABSTRACT

An HVAC monitoring system that tests for an abnormal environmental condition, wherein the abnormal condition results in effectuating a selected response from an HVAC building system, the HVAC monitoring system optionally including a sensor for detecting the gas abnormal condition, wherein a first event marker signal is generated from the sensor detecting the abnormal condition. Further included is control circuitry in a first communication with the sensor, wherein the control circuitry is in a ready state that is operative to monitor for the first event marker signal, wherein the control circuitry outputs a second event marker signal corresponding to the first event marker signal, a relay in a second communication with the control circuitry, the relay is operative to be in an activated operational state upon receiving the second event marker signal to operationally effectuate the selected response from the HVAC building system.

7 Claims, 17 Drawing Sheets

(56) References Cited

U.S. PATENT DOCUMENTS

| | | | | |
|---|---|---|---|---|
| 5,197,862 | A * | 3/1993 | Kladder | G01F 1/00 417/63 |
| 6,779,735 | B1 * | 8/2004 | Onstott | F24F 12/006 165/267 |
| 10,240,809 | B1 * | 3/2019 | Duvivier | F24D 19/1084 |
| 11,125,457 | B1 * | 9/2021 | Alfano | F24F 11/56 |
| 2003/0126869 | A1 * | 7/2003 | Liu | F24F 1/027 62/262 |
| 2004/0182942 | A1 * | 9/2004 | Head | F24F 11/30 374/147 |
| 2005/0031503 | A1 * | 2/2005 | Fox | F24F 8/192 422/186.04 |
| 2006/0154596 | A1 * | 7/2006 | Meneely | F24F 11/30 454/239 |
| 2008/0198524 | A1 * | 8/2008 | McConnell | F23M 11/00 361/91.2 |
| 2012/0248211 | A1 * | 10/2012 | Warren | G05D 23/19 236/1 C |
| 2015/0077243 | A1 * | 3/2015 | Hooper | G08B 17/06 340/532 |
| 2016/0187020 | A1 * | 6/2016 | Ishii | F24F 11/30 700/276 |
| 2017/0176027 | A1 * | 6/2017 | Eicher | F24F 13/28 |
| 2017/0193789 | A1 * | 7/2017 | Economy | F02D 17/04 |
| 2017/0337787 | A1 * | 11/2017 | Bryce | F24F 11/38 |
| 2018/0023828 | A1 * | 1/2018 | Lutz | H04B 1/3822 700/276 |
| 2018/0190459 | A1 * | 7/2018 | Situ | F24F 9/00 |
| 2019/0089156 | A1 * | 3/2019 | Kim | H02J 3/02 |
| 2020/0355385 | A1 * | 11/2020 | Liang | F25B 49/022 |
| 2021/0108823 | A1 * | 4/2021 | Takagi | F24F 1/20 |
| 2021/0222877 | A1 * | 7/2021 | Combe | E05F 15/72 |
| 2021/0265106 | A1 * | 8/2021 | Salunkhe | H01F 27/06 |

* cited by examiner

HVAC MONITORING SYSTEM

RELATED PATENT APPLICATIONS

This patent application claims the benefit of U.S. provisional patent application Ser. No. 63/143,040 filed on Jan. 29, 2021 by Rodney Craig Blincoe of Highlands Ranch, Colo., U.S. and this patent application also claims the benefit of U.S. provisional patent application Ser. No. 63/224,761 filed on Jul. 22, 2021 by Rodney Craig Blincoe of Highlands Ranch, Colo., U.S.

TECHNICAL FIELD

The present invention relates generally to a system for sending electrical signals. More specifically, the present invention relates to the field of building fire safety and control of building systems in the event of a building fire.

BACKGROUND OF INVENTION

Commercial buildings have long had additional fire safety procedures, inspections, and systems that residential buildings (housing) have typically not had, such as auto fire department calling when a fire detectors go off or when the building fire sprinkler system starting flowing, or when an exit door is opened. Further, commercial buildings can have Heating Ventilation and Air Conditioning (HVAC) systems automatically shutdown in the event of a fire to prevent spreading of toxic smoke, feeding the fire extra oxygen, or excessive cooling by the air conditioning system. Also, commercial systems have items like battery powered lighted EXIT signs in the event of electrical failure and smoke present and same goes for emergency stairway and hall lighting, in addition to automatic closing of fire doors for fire suppression, automatic elevator height level defaults for fireman to use, auto ventilation systems for removing smoke, and the like.

However, for residential buildings, fire safety has been minimal or at a much lower level, which is curious as people sleep at home, while they are awake at commercial buildings, i.e. while at work. So, in a sense, people are at more risk for fire danger at home while sleeping. It is interesting that building fire codes are typically much more strict for commercial buildings (where occupants are typically awake and alert) verses residential buildings (where occupants sleep and have higher risks for smoking, candles, fireplaces, and the like that typically don't exist in commercial buildings). Because of this there is a definite need for commercial type fire safety protection for residential buildings to enhance the safety of people in their homes, i.e. with a focus on automated systems that activate home building systems to enhance fire safety even while the home occupants are sleeping. There has been some activity in this area with KIDDE fire detectors that have wireless communication to one another, i.e. such that if there are multiple fire detectors within a single house and that if a single fire detector activates, then all the fire detectors alarm for notifying a house occupant that is located in the house in a remote area from the location of the original fire detection.

In looking at the prior art in the residential building digital transmission and data switching arts in U.S. Pat. No. 9,286,781 to Filson et al., discloses a smart home system that is assigned to Google that teaches digital interconnection between components that includes a thermostat, a fire detector, and cameras, using sensors that include smoke, audio, acceleration, seismic, temperature, humidity, and radiation, with all sensors communicating to an event processor that further analyzes the combination of sensor inputs to help ascertain whether an earthquake, tornado, power outage, or weather event has likely occurred, thus this system is primarily for notification purposes rather than any automated equipment change of operational state being effectuated.

Further in the above prior art area in U.S. Pat. No. 6,891,838 to Petite et al., disclosed is a monitoring and controlling system for residential buildings that includes a sensor that outputs a sensor data signal, a processor to format the sensor data signal for a particular function to evaluate the parameter for the sensor, and to create a follow on signal based on selected parameter values.

Continuing in the above prior art area in U.S. Pat. No. 10,403,127 to Sloo et al., disclosed is a smart home device that is assigned to Google wherein the smart home device provides follow up communications for detection events; the device includes a sensor that detects a dangerous condition in a home environment, a processor that determines a first state of moderate danger and then an second state then having the ability to determine whether the danger has ceased based on the first and second states. Again, this is a notification type system rather than an automated equipment change of operational state in reaction to sensor outputs.

Next in the above prior art area in U.S. Pat. No. 10,331,095 to Patel et al., discloses a method and system for an automation control device that includes a processor that is configured in response to receive an input message, map the message to a control message, and to determine a control action for the automation control asset.

Continuing in the above prior art area in U.S. Pat. No. 10,282,787 to Hakimi-Boushehri et al., disclosed is a system for determining a loss to a property that is assigned to State Farm Insurance, wherein the system includes a smart home controller that monitors a sensor that has data stored a baseline level of data, wherein when the sensor provides data outside of the baseline the controller will determine damage to the property based on the sensor input, and engaging in automated insurance company form submittal.

Moving onward in the above prior art area in U.S. Pat. No. 10,158,498 to Brandman et al., discloses a building sensor monitoring and control system that is assigned to the Hartford Fire Insurance Company, wherein the system includes multiple sensors that generate electronic signals that are evaluated for a risk situation, wherein signals with unique instructions are generated to try to mitigate the situation at the electromechanical device and if the conditions are not mitigated the system changes control parameters.

Further in the above prior art area in U.S. Pat. No. 10,361,878 to Loreille, discloses a system for initiating actions automatically on home smart devices that starts with a movement sensor action trigger signal that causes an action to initiate video recording and record a log.

Continuing in the prior art in U.S. Pat. No. 10,726,695 to Blincoe, disclosed is a building safety system that receives a first communication from a fire sensing appliance and translates the first communication to a building system to effectuate a selected response from the building system. The building safety system in Blincoe includes control circuitry in a ready state that is operative to monitor the first communication and to produce a first event market signal upon receipt of the first communication, the first event market signal is in a first electrical communication with the building system, wherein operationally the first event marker signal effectuates the selected response from the building system.

What is needed is a HVAC monitoring system that is positioned to fill a void in residential building fire protection being the failure to shut off the central ventilation system blower (HVAC) in the case of fire. In the event of a residential house fire when the HVAC unit is activated, the air blower (air conditioning) ramps up to compensate for the heat which further feeds the fire with oxygen from the air and spreads toxic gasses and smoke throughout the house further making the fire worse.

Currently in the prior art the vast majority of installed residential building fire alarm systems alert the user with a high-audible volume alarm appliance to allow the occupants to escape safely but do nothing to reduce the severity of the fire. The present invention is desirably easy to install and inexpensive that adds a layer of protection to residential buildings to help save lives and to help reduce property loss.

SUMMARY OF INVENTION

Broadly, the present invention is an HVAC monitoring system that tests an environment for an abnormal condition, wherein the abnormal condition results in effectuating a selected response from an HVAC building system, the HVAC monitoring system including a sensor for detecting the environment abnormal condition, wherein a first event marker signal is generated from the sensor detecting the environment abnormal condition. Further included in the HVAC monitoring system is control circuitry in a first communication with the sensor, wherein the control circuitry is in a ready state that is operative to monitor for the first event marker signal, wherein the control circuitry outputs a second event marker signal corresponding to the first event marker signal. Additionally included in the HVAC monitoring system is a relay in a second communication with the control circuitry, the relay is operative to be in an activated operational state upon receiving the second event marker signal to operationally effectuate the selected response from the HVAC building system.

These and other objects of the present invention will become more readily appreciated and understood from a consideration of the following detailed description of the exemplary embodiments of the present invention when taken together with the accompanying drawings, in which;

REFERENCE NUMBERS IN DRAWINGS

50 HVAC Monitoring System

Figure 1:
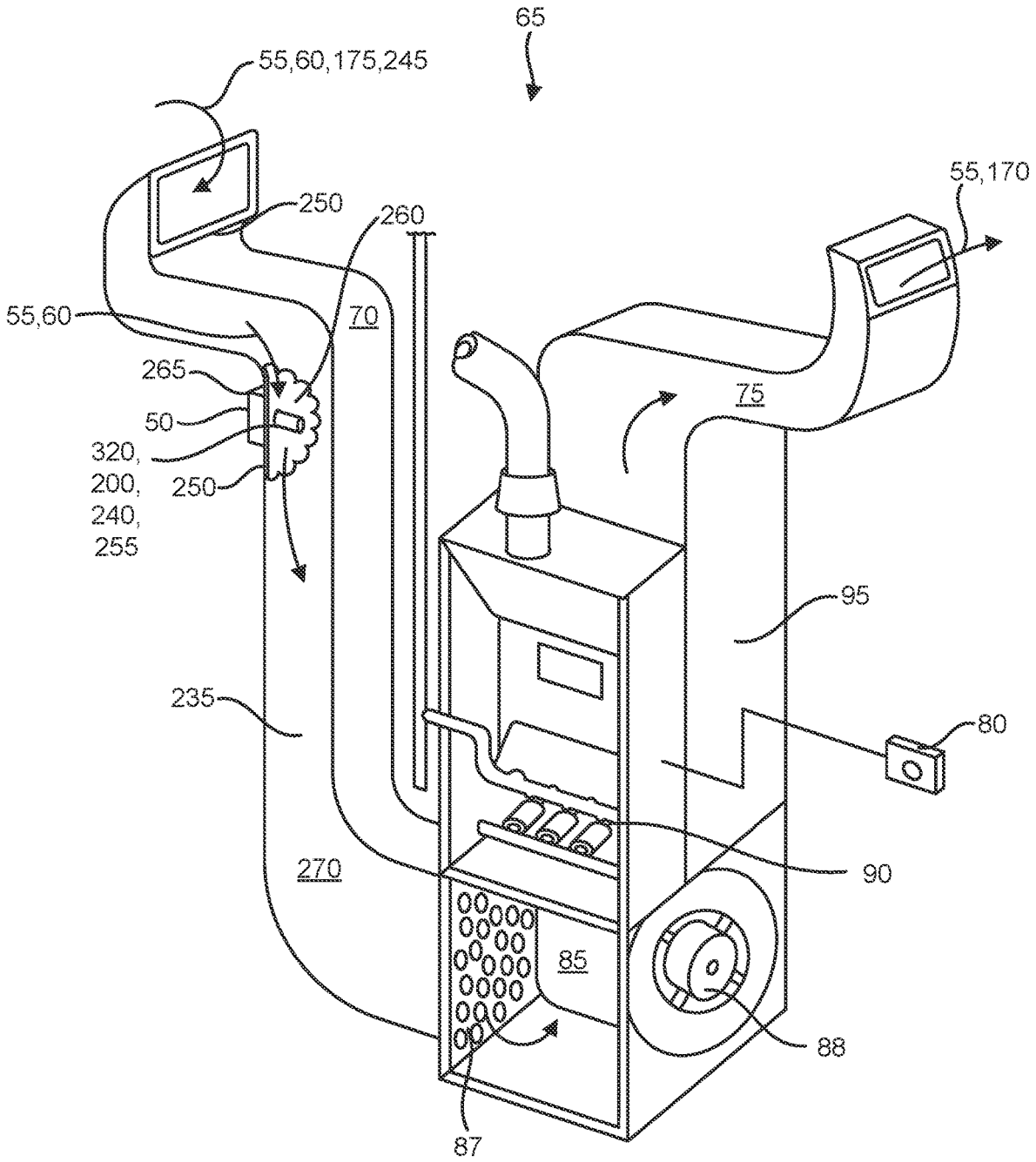
FIG. 1 shows an upper perspective view of a complete HVAC building system that includes a return duct, an exit duct, a thermostat, a heating element, a cooling element, a fan, and a fan motor; further shown is the HVAC monitoring system mounted in the return duct that includes a sensor with a probe extension and an external housing to show in context the HVAC monitoring system with the HVAC building system.

55 Environmental abnormal condition which can be typically air that is contaminated

60 Environmental abnormal condition which can be smoke in the air

65 HVAC building system that typically includes the return duct 70, the exit duct 75, the thermostat 80, the fan 85, the heating element 90, and the cooling element 95, the fan 85, and the fan motor 88, and the HVAC control circuit board 371

66 Power source for the fan motor 88

70 Return duct of the HVAC building system 65

75 Exit duct of the HVAC building system 65

80 Thermostat of the HVAC building system 65

85 Fan of the HVAC building system 65

86 Fan switch of the fan 85

87 Filter of the fan 85

88 Motor of the fan 85

90 Heating element of the HVAC building system 65

95 Cooling element of the HVAC building system 65

105 Selected response from of the HVAC building system 65 typically being the deactivation of the HVAC building 65 fan 85 via the fan motor 88

140 Fire

165 Residential or commercial building

170 HVAC air outlet or outlet air movement

175 HVAC air inlet or inlet air movement

200 Sensor, wherein the sensor can be but not limited to detecting the environment abnormal condition that is selected from the group including; ambient temperature, smoke ionization, smoke optical, smoke photoelectric, catalytic combustible gas sensor for; natural gas, hydrogen, or propane, a carbon monoxide detector, or an ultraviolet infrared flame detector

205 First event marker signal

210 Control circuitry

215 First communication that can be between the sensor 200 and the control circuitry 210, 505, 406, 601

220 Second event marker signal

225 Relay

226 Activated operational state of the relay 225

227 Un-activated operational state of the relay 225

230 Second communication that can be between the control circuitry 210, 505 and the relay 225, 510, plus control circuitry 505, 406, 601 and the relay 430, 440, 510, 625, 635

235 Structural ductwork of the return duct 70 of the HVAC building system 65

240 Sensor 200 disposed partially within the structural ductwork 235

245 Gas 55 flow of the structural ductwork 235

250 Sidewall of the structural ductwork 235

255 Probe extension of the sensor 200

260 Interior of the structural ductwork 235

265 External housing of the sensor 200

270 Outside of the sidewall 250

275 Third communication from the relay 225, 440, 510, 635 to the motor 88, 650 switch 86 for the fan 85, or HVAC power supply 515, or fuse module electrical power out 400

280 First reset timeout circuitry of the control circuitry 210, 415, 406, 505, 601, 660

285 Second reset timeout circuitry of the control circuitry 210, 415, 406, 505, 601, 660

300 First wireless signal

310 Second wireless signal

320 Existing sensor, wherein the existing sensor can be but not limited to detecting the environment abnormal condition that is selected from the group including; ambient temperature, smoke ionization, smoke optical, smoke photoelectric, catalytic combustible gas sensor for; natural gas, hydrogen, or propane, a carbon monoxide detector, or an ultraviolet infrared flame detector

330 Available first event marker signal

350 Sampling tube of the sensor 200

355 Plug of the sampling tube 350

360 Seal of the sampling tube 350

365 Exhaust tube of the sensor 200

370 Fuse module apparatus and associated housing

371 HVAC control circuitry board

375 Alternative mounting position of the HVAC control circuitry board 371 fuse 390

380 Fuse ports on the fuse module apparatus 370 that jumper wire into the HVAC control circuitry board 371 fuse connections 395, 400

385 Electrical neutral jumper wire port to the neutral electrical connection on the HVAC control circuitry board 371

390 Fuse that was ported into the original HVAC control circuitry board 371

395 Fuse jumper port wire "F1" 24 V power feed to HVAC control circuitry board 371 to fuse 390 port

400 Fuse jumper port wire "F2" power from fuse 390 to HVAC control circuitry board 371 power feed port

405 Neutral leg port jumper wire "N" white wire

406 Fuse module control circuitry

410 Normally closed NC stop button switch

415 Timer module—a selected time to re-enable the fuse module 370 after the HVAC ventilation shutdown identified as "RST"

420 Normally open NO enable button switch to place the fuse module 370 into the enabled state identified as EN

425 Green indicator light illuminated upon the enabled state of the fuse module 370

430 Normally open NO shut off solenoid will be energized when the sensor 200 senses a detection event identified as "SO" with the included fuse module control circuitry

435 Red indicator light illuminated upon solenoid 430 being energized

440 Normally closed NC relay shutoff upon energizing of solenoid 430 that will open the 24V circuit using the included fuse module control circuitry

445 Normally open NO relay to energize the timer module 415 upon energizing solenoid 430

450 Normally open NO relay closing to illuminate red light 435 upon energizing of solenoid 430

500 Bluetooth signal hotwire in-line relay shutoff apparatus

505 Control circuitry 210 preferably in the form of an Arduino Uno micro controller board part number ELEGOO-UNO-R3

510 Normally closed NC relay to open circuit upon control circuitry 505 output in the form of the second communication 230

515 HVAC power supply

600 Inline hotwire relay apparatus and radio frequency RF shutdown system

601 Inline hotwire relay apparatus control circuitry

605 Neutral leg utility power feed wire 120V

610 Normally closed NC stop button switch

615 Normally open NO enable button switch

620 Green indicator light illuminated upon enabled state of switch 615

625 Normally open shutoff solenoid will be energized when the sensor 200 senses a detection event with the included inline hotwire relay apparatus control circuitry 601

630 Red indicator light illuminated upon solenoid 625 being energized

635 Normally closed NC relay shutoff opening upon energizing of solenoid 625 that will open the 120V circuit to the motor 650 using the included inline hotwire relay apparatus control circuitry 601

640 Normally open NO relay closing to illuminate red light 630 upon energizing of solenoid 625

645 Power feed from utility 120V hot leg

650 HVAC blower motor also shown as motor 88

655 Normally closed NC overload relay opens upon motor 650, 88 over current

660 Timer module—a selected time to re-enable the inline hotwire relay apparatus 600 after the HVAC ventilation shutdown

DETAILED DESCRIPTION

With initial reference to FIG. 1 shown is an upper perspective view of the complete HVAC system 65 environment that includes the return duct 70, the exit duct 75, the thermostat 80, the heating element 90, the cooling element 95, the fan 85, and the fan motor 88, further shown is the HVAC monitoring system 50 mounted in the return duct 70 that includes the sensor 200 probe extension 255 and the external housing 265 to show in context the HVAC monitoring system 50 with the HVAC system 65.

Figure 2:
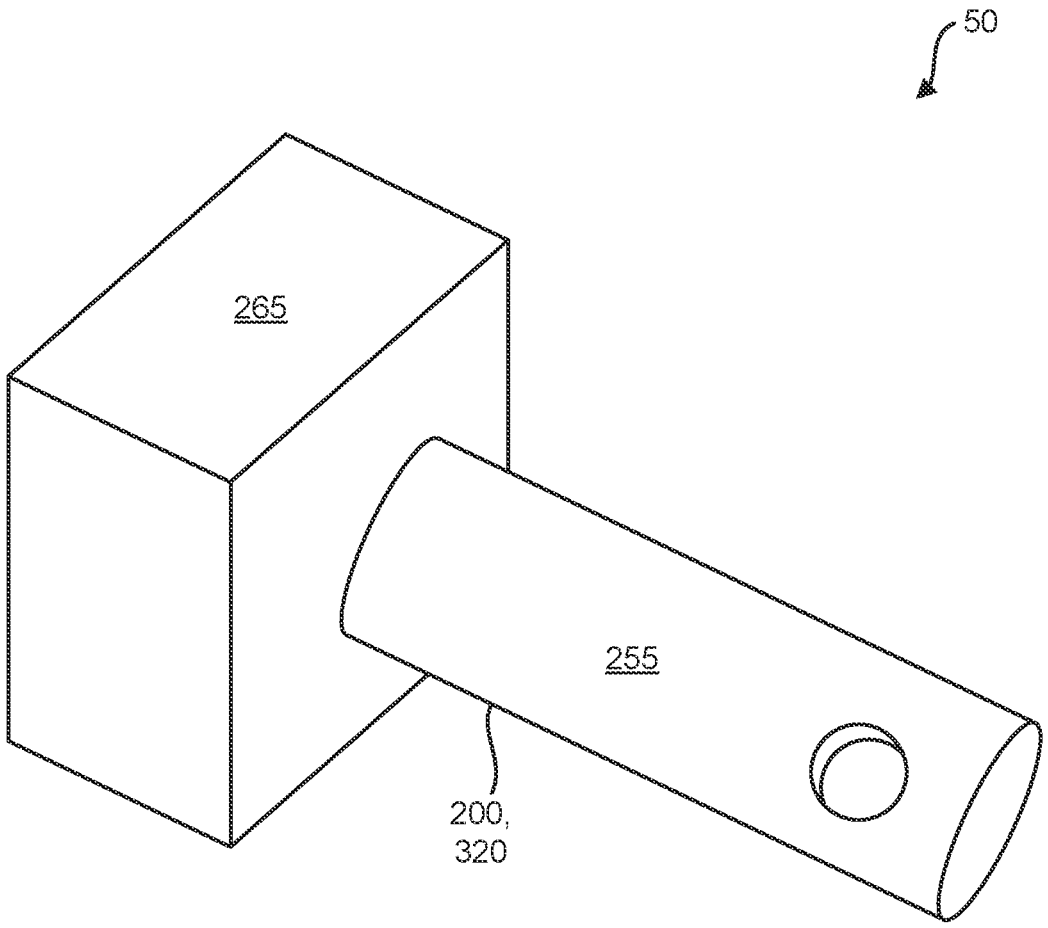
FIG. 2 shows a front upper perspective view of the HVAC monitoring system that includes the sensor probe extension and the external housing.
Figure 3:
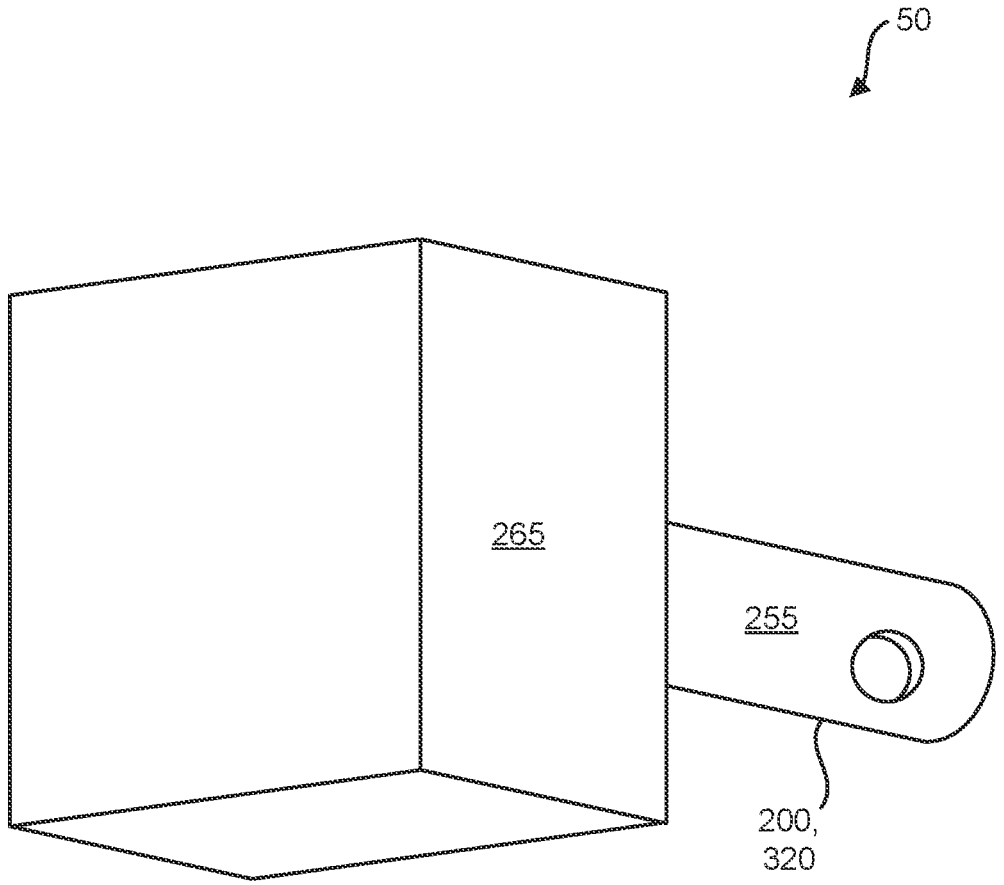
FIG. 3 shows a rear upper perspective view of the HVAC monitoring system that includes the sensor probe extension and the external housing.
Figure 4:
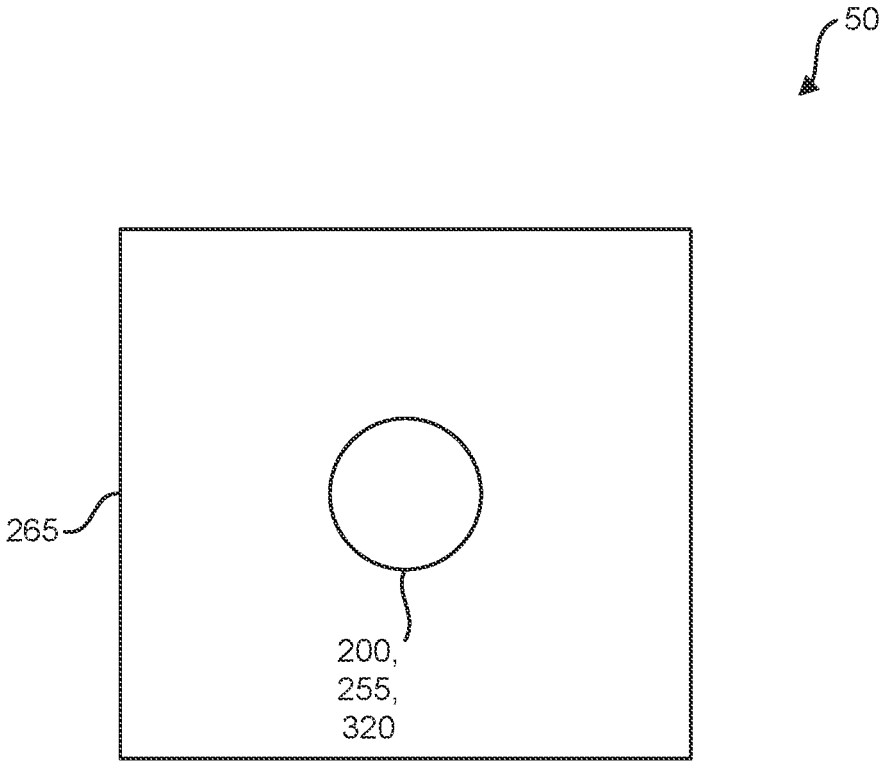
FIG. 4 shows a front side elevation view of the HVAC monitoring system that includes the sensor probe extension and the external housing.

Continuing, FIG. 2 shows the front upper perspective view of the HVAC monitoring system 50 that includes the sensor 200 probe extension 255 and the external housing 265, and FIG. 3 shows the rear upper perspective view of the HVAC monitoring system 50 that includes the probe extension 255 and the external housing 265. Further, FIG. 4 shows the front side elevation view of the HVAC monitoring system 50 that includes the probe extension 255 and the external housing 265.

Figure 5:
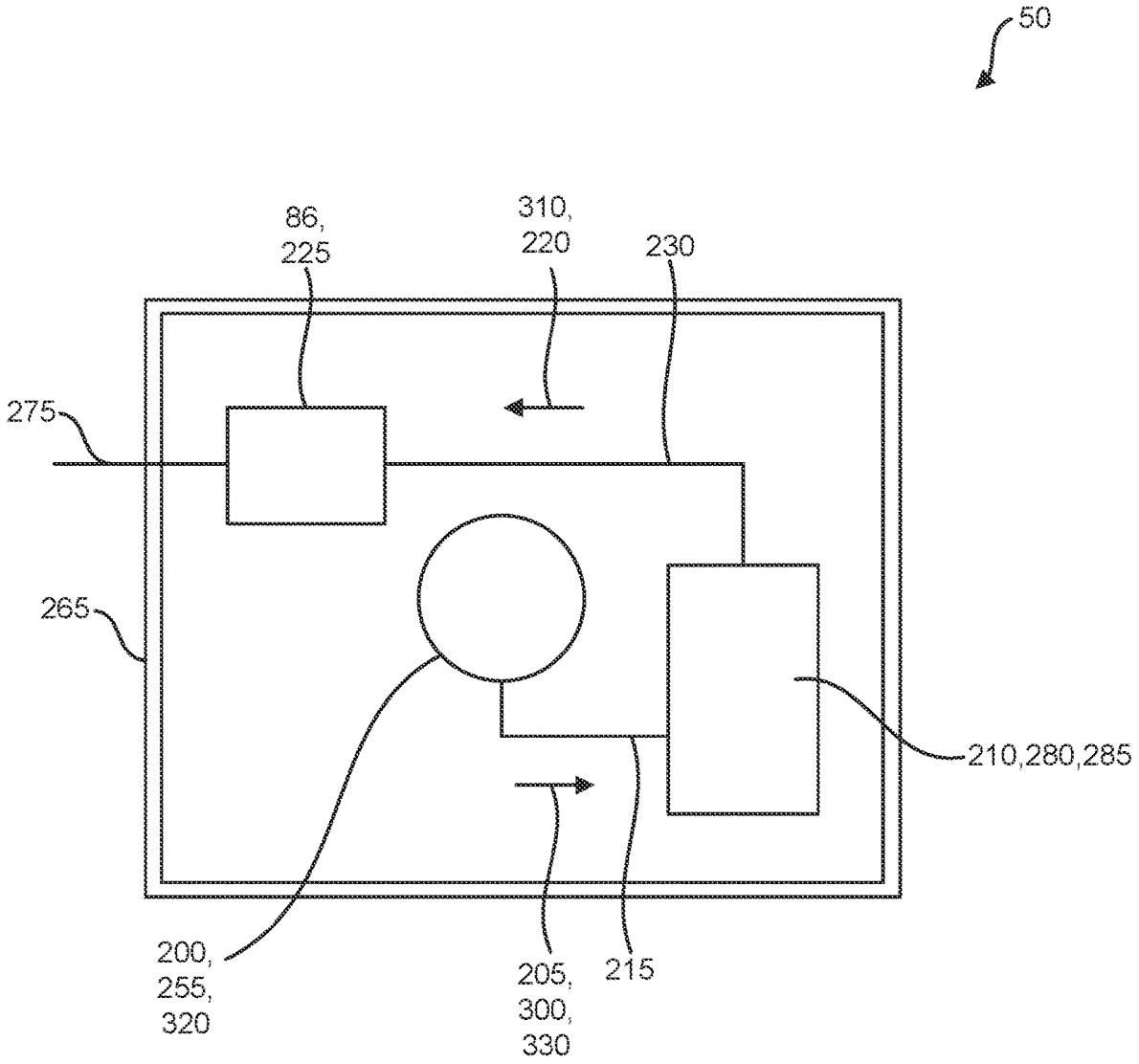
FIG. 5 shows a rear side elevation view of the HVAC monitoring system that includes the sensor probe extension and the external housing, wherein shown are components that includes control circuitry and a relay.
Figure 6:
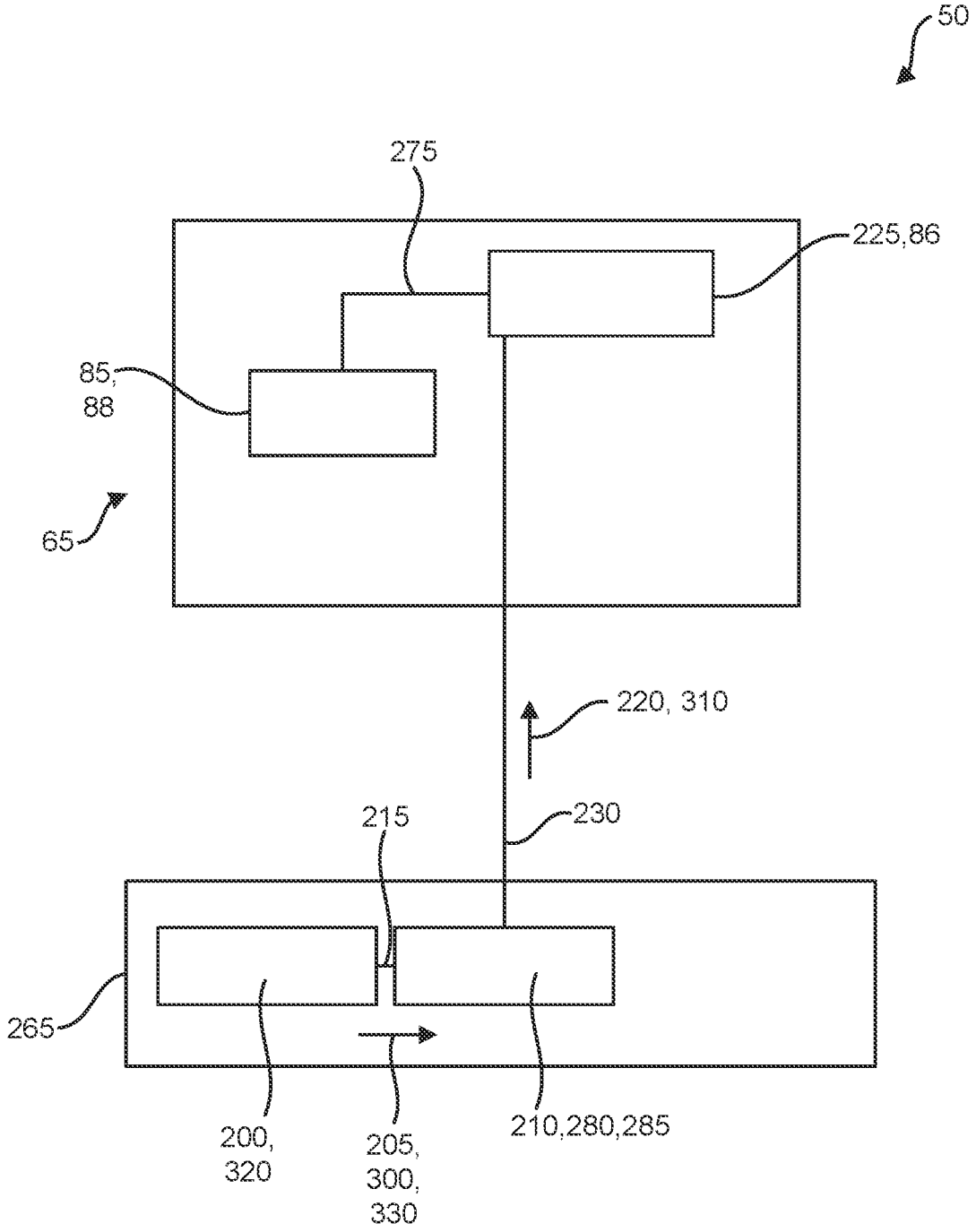
FIG. 6 shows a schematic block diagram of the HVAC monitoring system that includes the sensor, the control circuitry, the relay, and the fan/motor combination.

Moving onward, FIG. 5 shows a rear side elevation view of the HVAC monitoring system 50 that includes the sensor 200 probe extension 255 and the external housing 265, wherein shown are components that include the control circuitry 210 and the relay 225. Next, FIG. 6 shows a schematic block diagram of the HVAC monitoring system 50 that includes the sensor 200, the control circuitry 210, the relay 225, and the fan 85/motor 88 combination.

Figure 7:
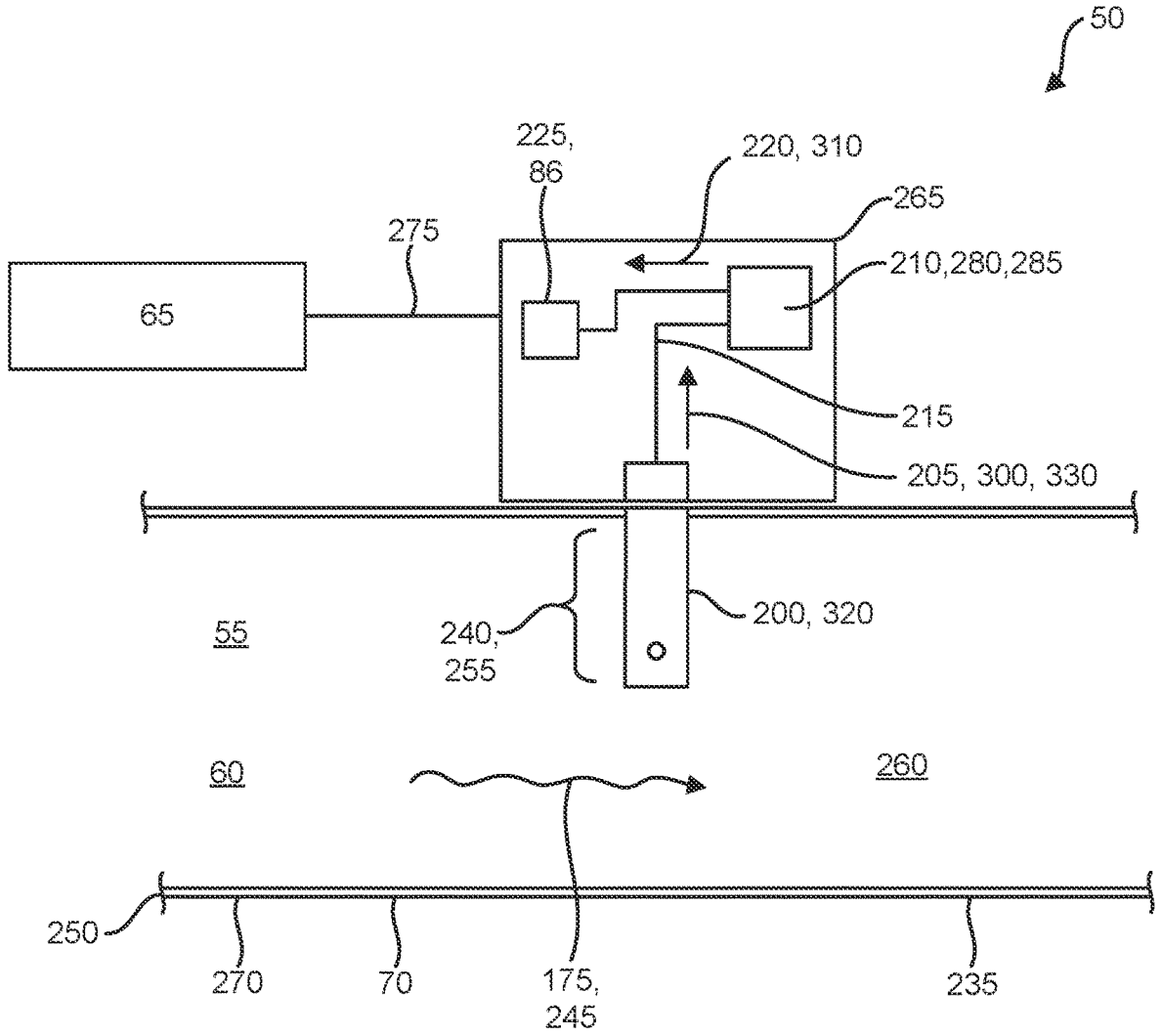
FIG. 7 shows a side elevation cross section of the HVAC monitoring system installed in the return duct interior of the structural ductwork that includes the sensor, the probe extension, the external housing with the control circuitry and relay.
Figure 8:
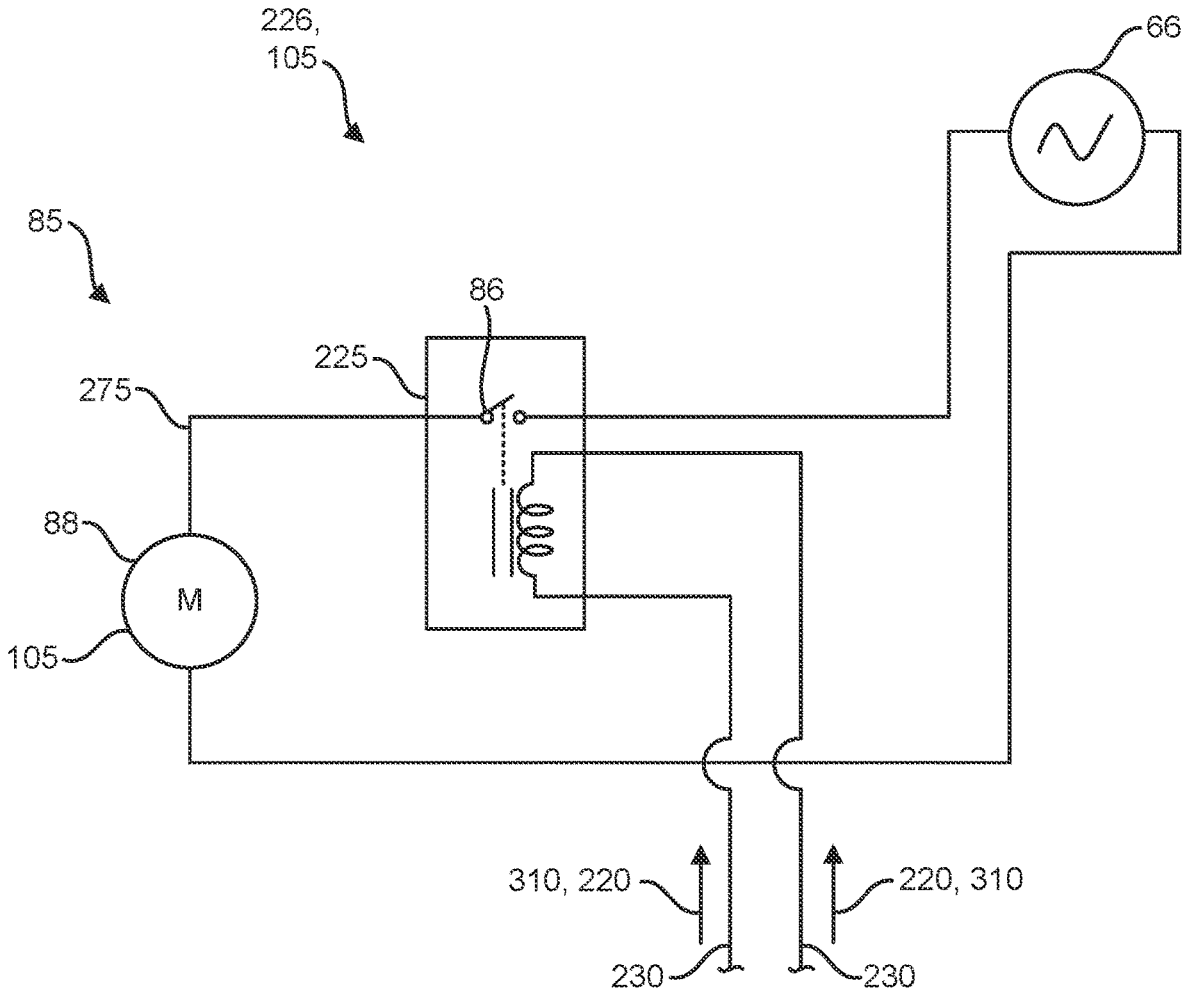
FIG. 8 shows a schematic diagram of the relay in an activated state that opens the shown circuit as between the power source and the fan motor, wherein also shown is the second communication to the relay.
Figure 9:
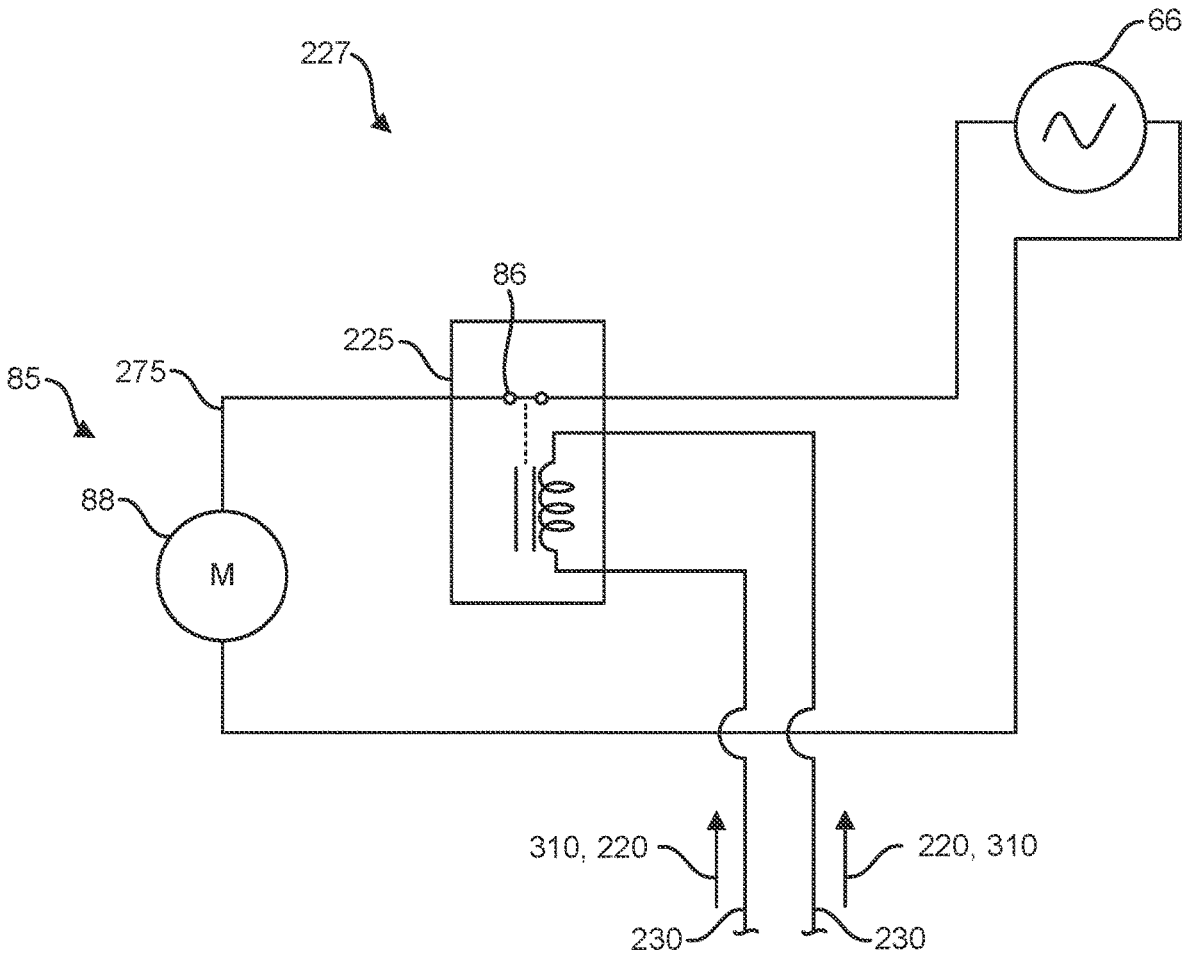
FIG. 9 shows a schematic diagram of the relay in an un-activated state that closes the shown circuit as between the power source and the fan motor, wherein also shown is the second communication to the relay.

Further, FIG. 7 shows a side elevation cross section of the HVAC monitoring system 50 installed in the return duct 70 interior 260 of the structural ductwork 235 that includes the sensor 200, the probe extension 255, the external housing 265 with the control circuitry 210 and relay 225. Next, FIG. 8 shows a schematic diagram of the relay 225 in an activated state 226 that opens the shown circuit as between the power source 66 and the fan motor 88, wherein also shown is the second communication 230 to the relay 225. Continuing, FIG. 9 shows a schematic diagram of the relay 225 in an un-activated state 227 that closes the shown circuit as between the power source 66 and the fan motor 88, wherein also shown is the second communication 230 to the relay 225.

Figure 10:
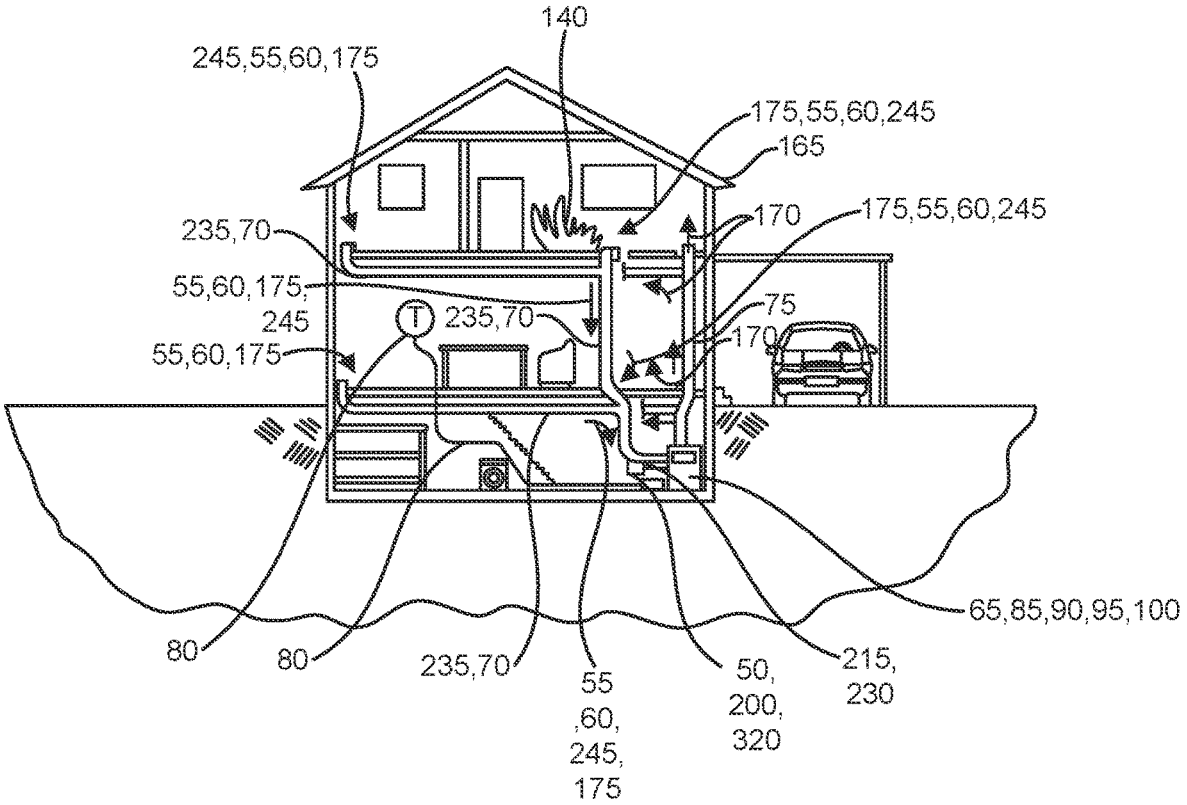
FIG. 10 shows a side elevation cross section of a use and installed drawing of the HVAC monitoring system, wherein the building is a typical residential structure with a basement, main floor, and a second story. Further, in FIG. 10 the residential structure shows a building system in the form of a typical heating ventilation and cooling system (HVAC) in the basement with HVAC floor by floor air outlets shown and HVAC floor by floor air inlets shown throughout the residential structure as is also typical. Further shown in FIG. 10 are the return and exit ducts, wherein specifically the HVAC monitoring system sensor is shown mounted in the return duct, wherein operationally if a fire occurs as shown on the second floor, the sensor will detect smoke in the return duct and generate a first event marker signal through a first communication with the control circuitry that concurrently generates a second event market signal to a relay through the second communication placing the relay into an activated state that opens the power supply circuit to the fan motor of the HVAC building system to stop the circulation of air at the return duct inlets and exit duct outlets to help prevent feeding the fire oxygen, to stop the HVAC building system from trying to cool the residential structure, and to help prevent the circulation of toxic smoke throughout the residential building structure to lessen the negative effects of the fire.

Moving onward, FIG. 10 shows a side elevation cross section of a use and installed drawing of the HVAC monitoring system 50, wherein the building 165 is a typical residential structure with a basement, main floor, and a second story, further the residential structure 165 shows a building system in the form of a typical heating ventilation and cooling system 65 (HVAC) in the basement with HVAC floor by floor air outlets 170 shown and HVAC floor by floor air inlets 175 shown throughout the residential structure as is also typical, further shown are the return 70 and exit 75 ducts.

Wherein specifically in FIG. 10 the HVAC monitoring system 50 sensor 200 is shown mounted in the return duct 70, wherein operationally if a fire 140 occurs as shown on the second floor, the sensor 200 can detect smoke 60 in the return duct 70 and generate a first event marker signal 205 through a first communication 215 with the control circuitry 210 that concurrently generates a second event market signal 220 to a relay 225 in through the second communication 230 placing the relay 225 into the activated state 226 that opens the power supply circuit to the fan motor 88 of the HVAC building system 65 to stop the circulation of air 55 at the return duct 70 inlets 175 and exit duct 75 outlets 170 to help prevent feeding the fire 140 oxygen, to stop the HVAC building system 65 from trying to cool the residential structure 165, and to help prevent the circulation of toxic smoke 60 throughout the residential building 165 structure to lessen the negative effects of the fire 140.

Figure 11:
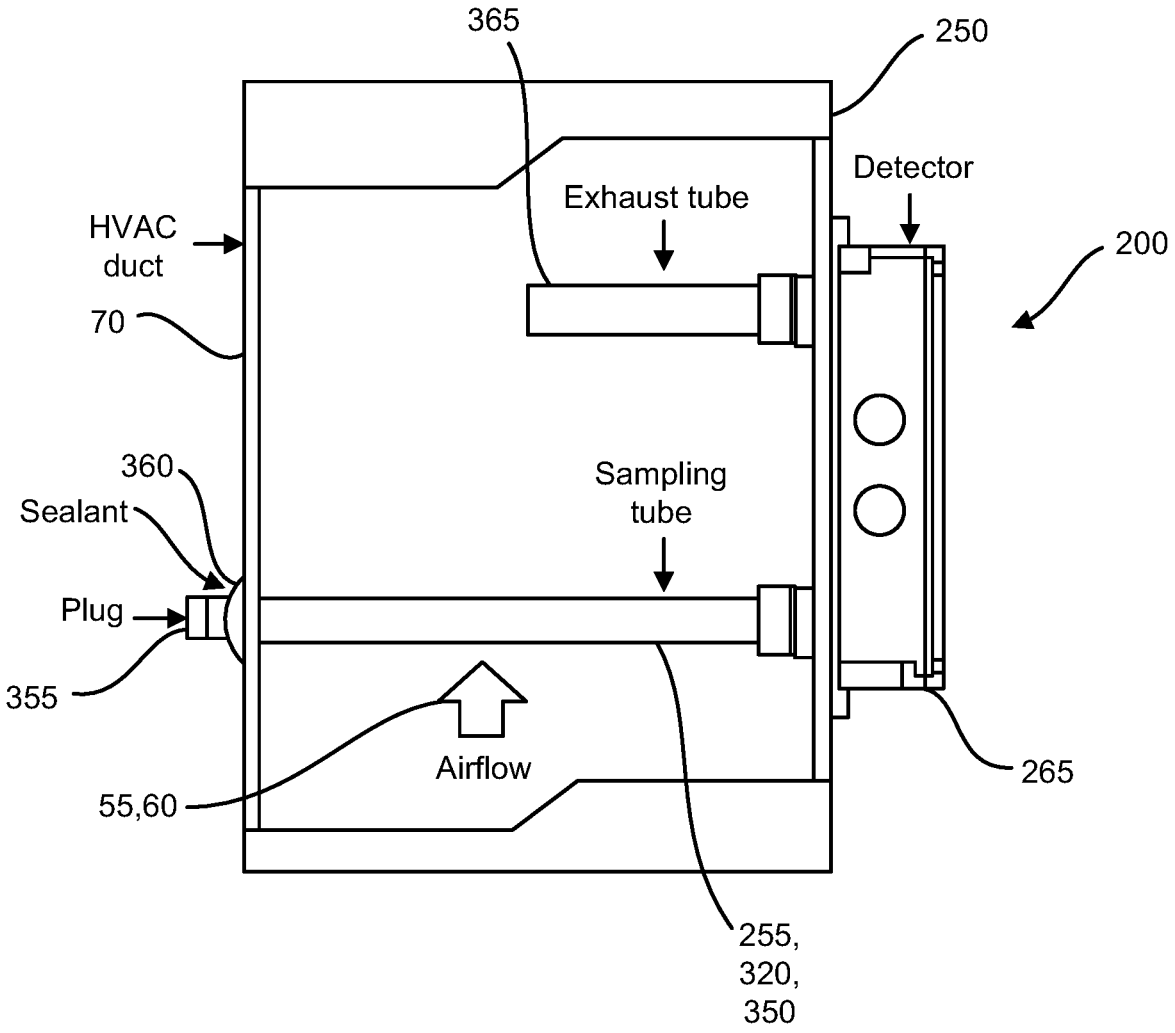
FIG. 11 shows a cross section of the HVAC inlet duct with the sensor mounted in the duct sidewall that also shows the sensor housing, the sensor sampling tube, and the sensor exhaust tube with the typical airflow direction.
Figure 12:
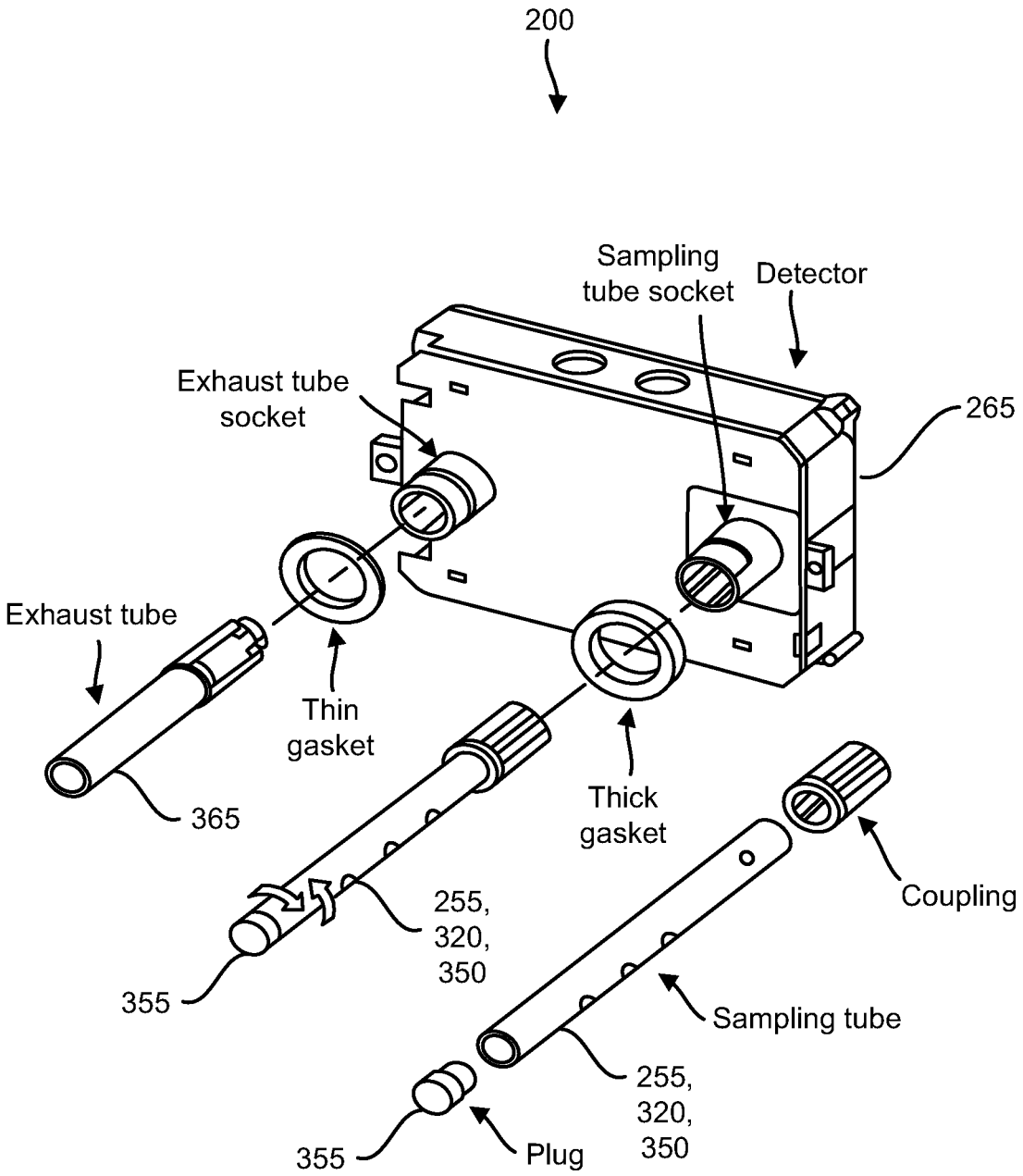
FIG. 12 shows an upper perspective view of the sensor in detail including the sampling tube, the exhaust tube, and the sensor housing.

Continuing, FIG. 11 shows a cross section of the HVAC inlet duct 70 with the sensor 200 mounted in the duct sidewall 250 that also shows the sensor 200 housing 265, the sensor 200 sampling tube 350, and the sensor 200 exhaust tube 365 with the typical airflow 55, 60 direction. Next, FIG. 12 shows an upper perspective view of the sensor 200 in detail including the sampling tube 350, the exhaust tube 365, and the sensor 200 housing 265.

Figure 13:
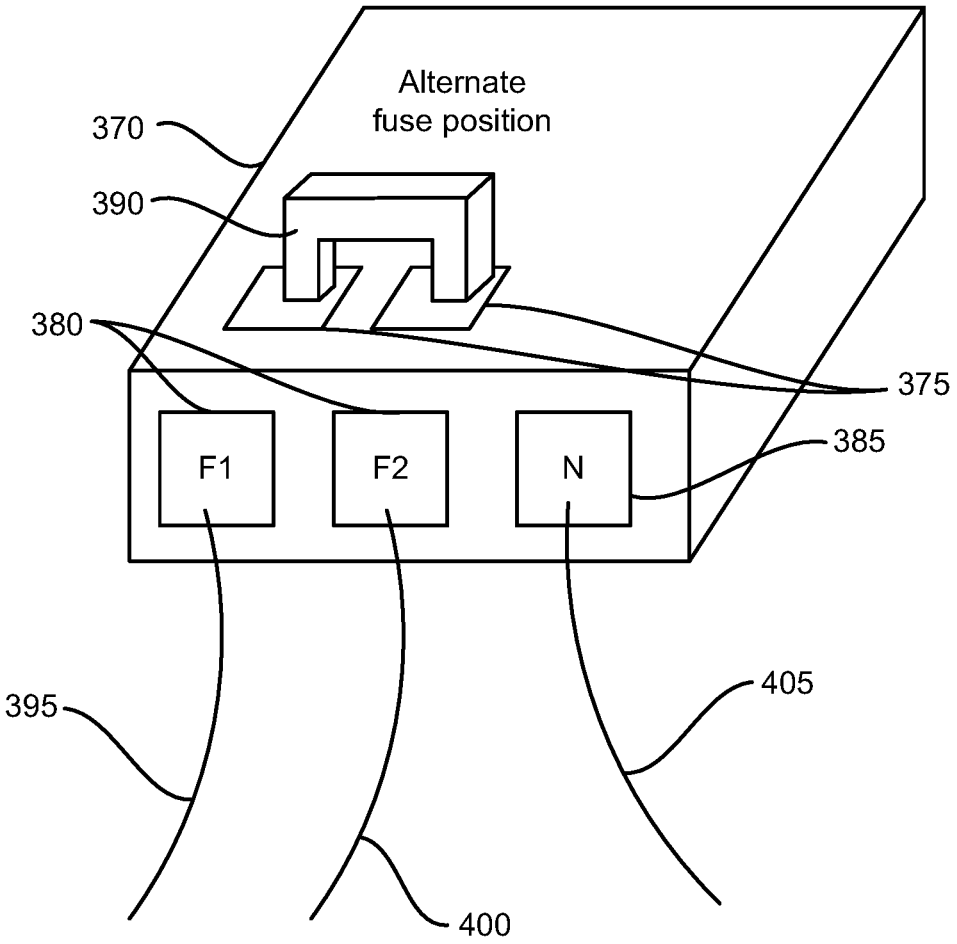
FIG. 13 shows an upper perspective view of the fuse module housing apparatus that includes the original HVAC control circuitry board fuse, the replacement F1 and F2 fuse wire ports, and the neutral wire port.
Figure 14:
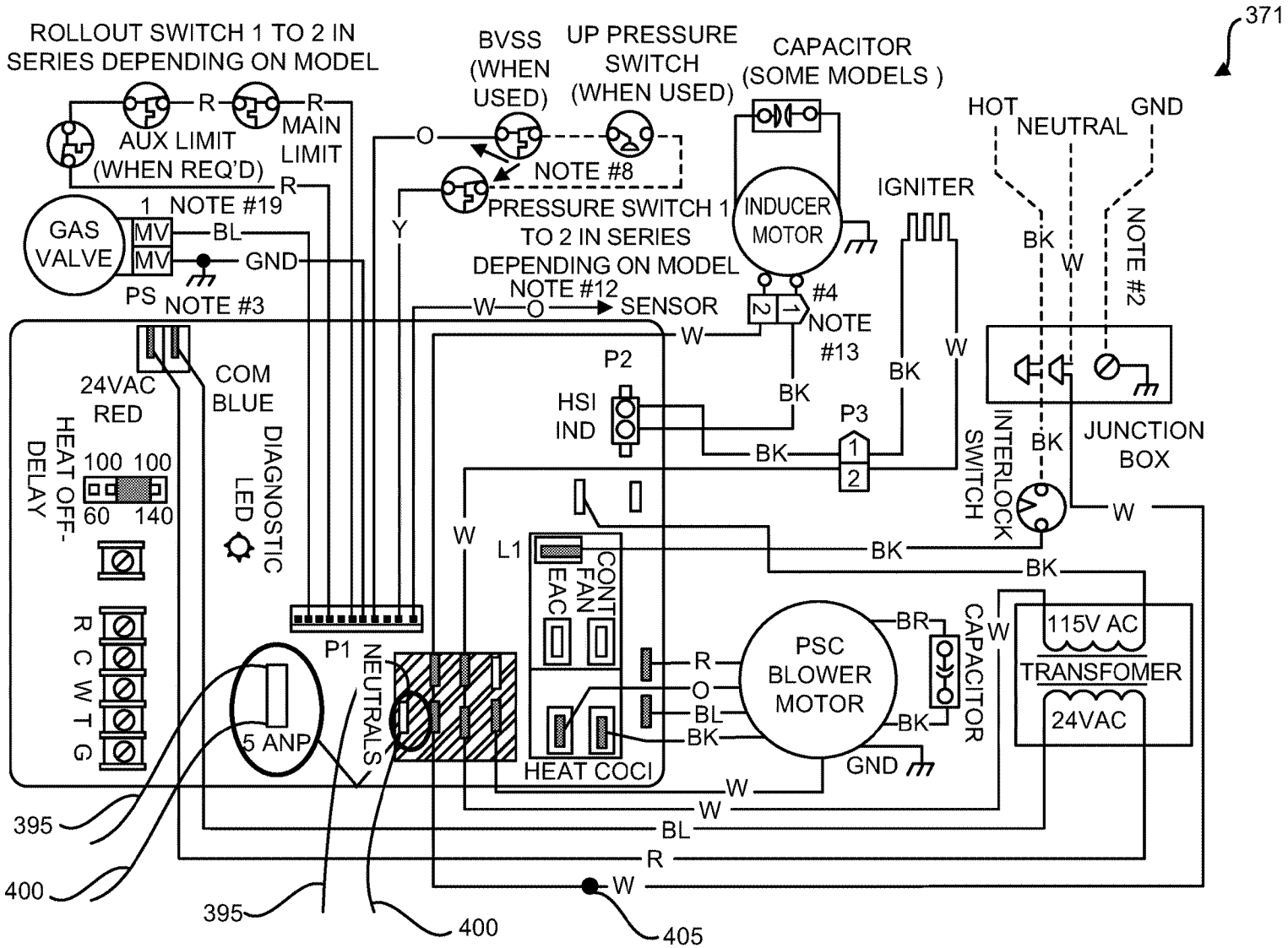
FIG. 14 shows a wiring schematic of a typical HVAC control circuitry board that shows where the fuse module housing apparatus interfaces with the HVAC control circuitry board basically at the 24V fused electrical power feed for the HVAC control circuitry board electronics where the replacement F1 and F2 fuse wire ports, and the neutral wire port from the fuse module housing apparatus are in electrical communication with the HVAC control circuitry board.

Further, FIG. 13 shows an upper perspective view of the fuse module housing 370 apparatus that includes the original HVAC control circuitry board 371 fuse 390, the replacement "F1" 395 and "F2" 400 fuse wire ports, and the neutral wire port 405. Next, FIG. 14 shows a wiring schematic of a typical HVAC control circuitry board 371 that shows where the fuse module housing apparatus 370 interfaces with the HVAC control circuitry board 371 basically at the 24V fused electrical power feed 395 for the HVAC control circuitry board 371 electronics where the replacement "F1" 395 and "F2" 400 fuse wire ports, and the neutral wire port 405 from the fuse module housing apparatus 370 are in electrical communication with the HVAC control circuitry board 371 as shown in FIG. 14.

Figure 15:
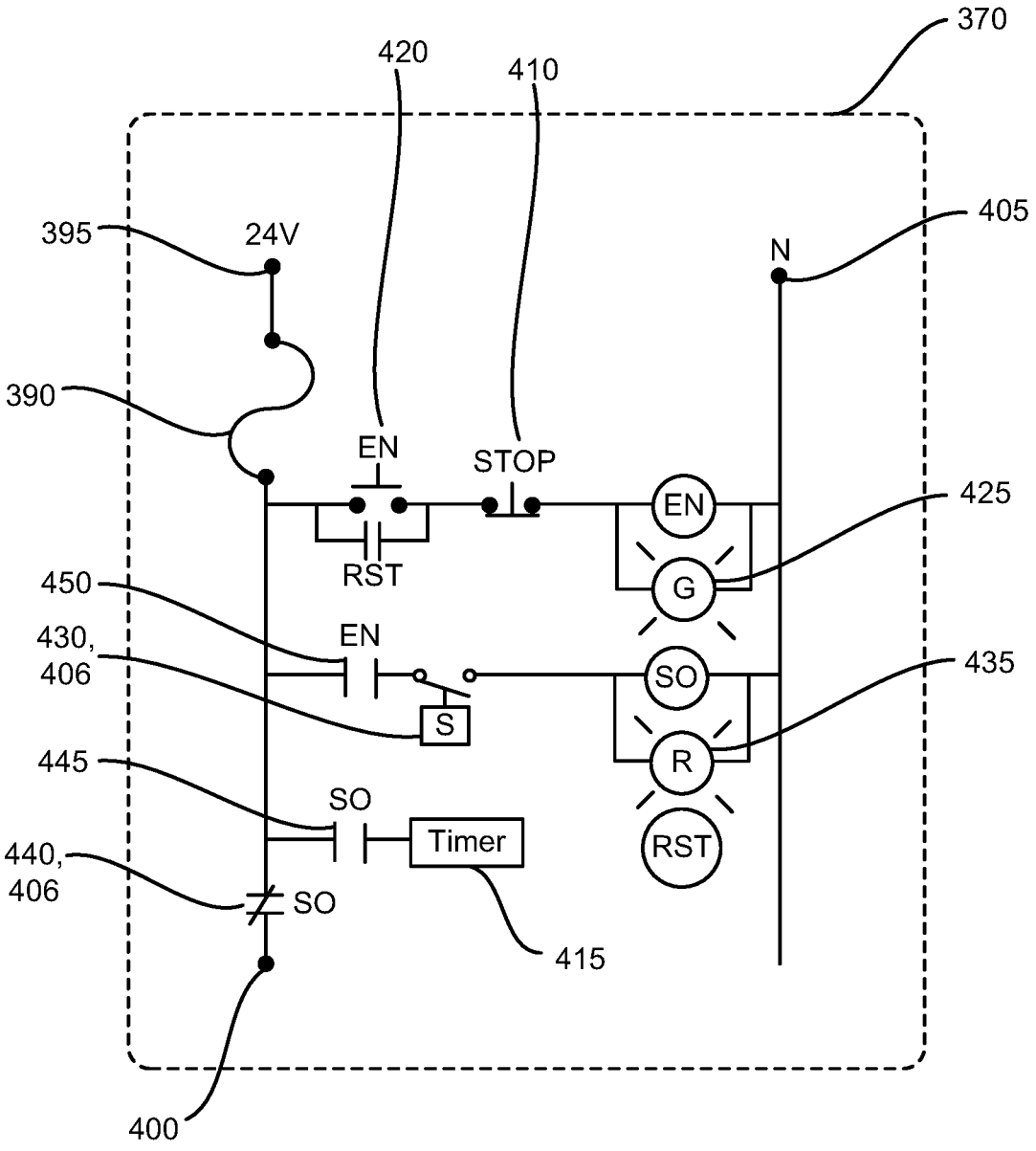
FIG. 15 shows a ladder schematic of the fuse module housing apparatus that includes the 24V and neutral power feeds, plus the start/stop switches with NO relay, the shutdown solenoid of the sensor (not shown) with NO and NC relays, and the timer with NO relay, plus red and green indicator lights.

Continuing, FIG. 15 shows a ladder schematic of the fuse module housing apparatus 370 that includes the 24V 395 and neutral 405 power feeds, plus the start 420/stop 410 switches with NO relay, the shutdown solenoid 430 of the sensor 200 (not shown) with NO 450 and NC 440 relays, and the timer 415 with NO relay 445, plus red 435 and green 425 indicator lights.

Figure 16:
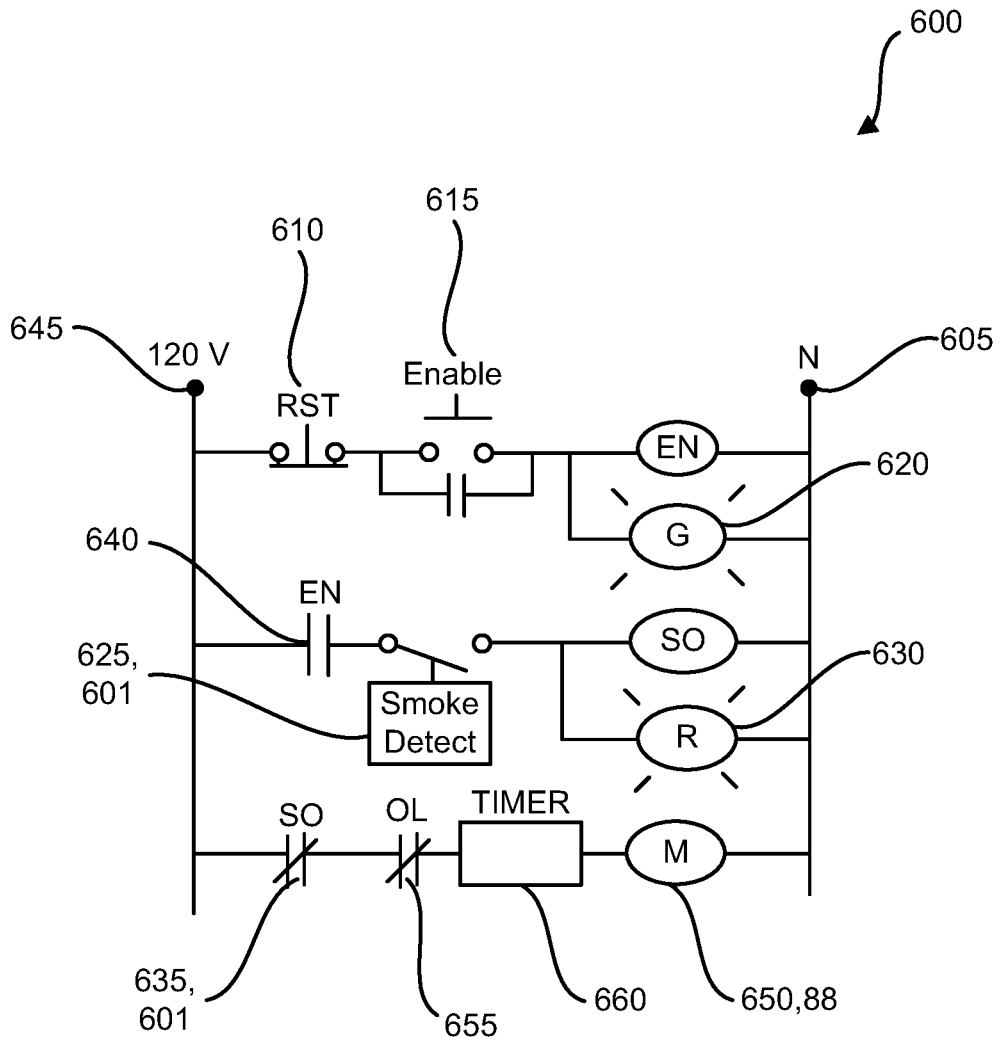
FIG. 16 shows a ladder schematic of the inline hotwire relay apparatus and radio frequency RF shutdown system that includes the 120V and neutral power feeds, plus the start/stop switches with NO relay, the shutdown solenoid of the sensor (not shown) with NO and NC relays, and the overload with NC relay, plus red and green indicator lights with the HVAC blower motor.

Moving onward, FIG. 16 shows a ladder schematic of the inline hotwire relay apparatus and radio frequency RF shutdown system 600 that includes the 120V 645 and neutral 605 power feeds, plus the start 615/stop 610 switches with NO relay, the shutdown solenoid 625 of the sensor 200 (not shown) with NO 640 and NC 635 relays, and the overload with NC 655 relay, plus red 630 and green 620 indicator lights with the HVAC blower motor 650.

Figure 17:
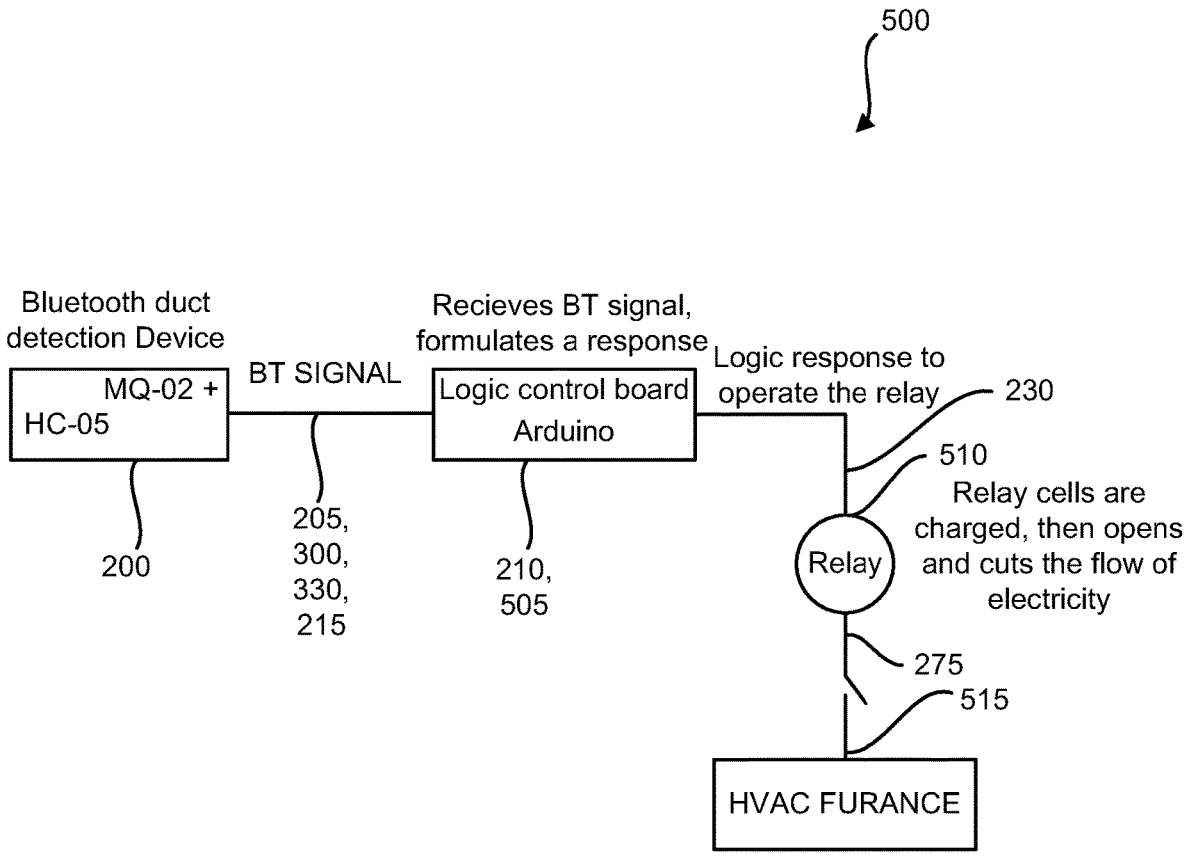
FIG. 17 shows an electrical block diagram of the Bluetooth signal hotwire in-line relay shutoff apparatus that includes the sensor in a first communication with the micro controller board that is in a second communication with the NC relay that is in a third communication with the HVAC electrical power supply.

Next, FIG. 17 shows an electrical block diagram of the bluetooth signal hotwire in-line relay shutoff apparatus 500 that includes the sensor 200 in a first communication 215 with the micro controller board 505 that is in a second communication 230 with the NC relay 510 that is in a third communication 275 with the HVAC electrical power supply 515.

Broadly, the present invention is an HVAC monitoring system 50, that tests the environment 55 for the abnormal condition 60, wherein the abnormal condition 60 results in effectuating the selected response 105 from the HVAC building system 65, the HVAC monitoring system 50 including the sensor 200 for detecting the environment 55 abnormal condition 60, wherein the first event market signal 205 is generated from the sensor 200 detecting the environment 55 abnormal condition 60, see in particular FIGS. 1 and 10, plus FIG. 7, plus FIGS. 11, 12, and 17. Further included in the HVAC monitoring system is control circuitry 210 that is in the first communication 215 with the sensor 200, wherein the control circuitry 210 is in a ready state that is operative to monitor for the first event marker signal 205, wherein the control circuitry 210 outputs the second event marker signal 220 corresponding to the first event marker signal 205, see FIGS. 5 to 9 and FIGS. 11, 12, and 17.

Additionally included in the HVAC monitoring system 50, is the relay 225 that is in the second communication 230 with the control circuitry 210, the relay 225 is operative to be in an activated operational state 226 upon receiving the second event marker signal 220 to operationally effectuate the selected response 105 from the HVAC building system 65, again see FIGS. 5 to 9, and FIGS. 11, 12, and 17.

As an option on the HVAC monitoring system 50, the sensor 200 can be sized and configured to be disposed partially 240 within the structural ductwork 235, wherein operationally the sensor 200 monitors the return duct 70 gas 55 flow 245 to determine the environment 55 abnormal condition 60, as best shown in FIGS. 1 and 7, plus FIGS. 11 and 12.

Another option for the HVAC monitoring system 50, the sensor 200 can be sized and configured to be disposed partially 240 within the structural ductwork 235 that is constructed of the sensor 200 being mounted in the duct sidewall 250 with a sensor 200 probe extension 255 disposed within the duct interior 260 and the sensor 200 including the housing 265 external to the duct interior 260 on an outside 270 of the duct sidewall 250, see FIGS. 1, 7, 10, 11, and 12.

A further option for the HVAC monitoring system 50, wherein the sensor 200 can include the housing 265 that has the control circuitry 210 disposed within, see in particular FIGS. 2 to 7 and FIGS. 11 and 12. Continuing, alternatively for the HVAC monitoring system 50, wherein the sensor 200 housing 265 can also have the relay 225 disposed within the housing 265, as again best shown in FIGS. 2 to 7, and FIGS. 11 and 12.

Another alternative for the HVAC monitoring system 50, wherein the relay 225 is in the third communication 275 with the HVAC building system 65 such that when the relay 225 is in the activated operational state 226 the HVAC building system 65 fan 85 motor 88 is deactivated, see in particular FIGS. 8 and 9, plus FIGS. 5 to 7, plus FIG. 17.

A continuing alternative for the HVAC monitoring system 50, is for the control circuitry 210 to optionally further comprises the first reset timeout circuitry 280 that can operationally accommodate false alarms via the second event marker signal 220 being manually terminated within a first selected time period and placing the control circuitry 210 in the ready state, see FIGS. 5 to 7, and FIG. 17.

A further continuing alternative for the HVAC monitoring system 50, again is for the control circuitry 210 to further comprise the second reset timeout circuitry 285 that can operationally reset the control circuitry 210 into the ready state after the first communication 215 naturally terminates after the first selected time period then having the second selected clearing time period prior to placing the control circuitry 210 into the ready state in order to prevent a second subsequent false alarm.

Looking at FIGS. 1 to 12, and 17, the HVAC monitoring system 50, that tests the environment 55 for an abnormal condition, 60 wherein the abnormal condition 60 results in effectuating a selected response from an HVAC building system 50, the HVAC monitoring system 50 including a sensor 200 for detecting the environment 55 abnormal condition 60, wherein a first event marker signal 205 is generated from the sensor 200 detecting the environment 55 abnormal condition 60.

Further included in the HVAC monitoring system 50, is control circuitry 210 in a first communication 215 with the sensor 200, wherein the control circuitry 210 is in a ready state that is operative to monitor for the first event marker signal 205, wherein the control circuitry 210 outputs a second event marker signal 220 corresponding to the first event marker signal 205, and a relay 225 in a second communication 230 with the control circuitry 210, the relay 225 is operative to be in an activated operational state 226 upon receiving the second event marker signal 220 to operationally effectuate the selected response from the HVAC building system 65, see FIGS. 5 to 9, plus FIGS. 11, 12, and 17.

Optionally, for the HVAC monitoring system 50, wherein the first event marker signal 205 is configured to be a first wireless signal 300 from the sensor 200 and the control circuitry 210 is configured to receive the first wireless signal 300, see FIGS. 5 to 7, plus FIGS. 11, 12, and 17.

Another option for the HVAC monitoring system 50, is wherein the second event marker signal 220 is configured to be a second wireless signal 310 from the control circuitry 210 and the relay 225 is configured to receive the second wireless signal 310, see FIGS. 5 to 9, plus FIGS. 11, 12, and 17.

A further option for the HVAC monitoring system 50, wherein the first wireless signal 300 is selected from the group consisting of blue-tooth, radio frequency, infra-red, microwave, or WiFi, and the second wireless signal 310 is selected from the group consisting of bluetooth, radio frequency, infra-red, microwave, or WiFi, see FIGS. 5 to 9, plus FIGS. 11, 12, and 17.

Another option for the HVAC monitoring system 50, wherein the sensor 200 can be disposed within a housing 265 that has the control circuitry 210 disposed within, also the sensor housing 265 can have the relay 225 disposed within, further the sensor 200 can be a smoke sensor, see FIGS. 2 to 7, plus FIGS. 11, 12, and 17.

An additional option for the HVAC monitoring system 50, wherein the relay 225 is in a third communication 275 with the HVAC building system 50 such that when the relay 225 is in the activated operational state 226 the HVAC building system 50 is completely deactivated, see FIGS. 5 to 9, plus FIGS. 11, 12, and 17.

Yet, another option for the HVAC monitoring system 50, wherein the control circuitry 210 can further comprise a first reset timeout circuitry 280 that can operationally accommodate false alarms via the second event marker signal 220 being manually terminated within a first selected time period and placing the control circuitry 210 in the ready state, see FIGS. 5 to 7, plus FIGS. 11, 12, and 17.

Continuing, another option for the HVAC monitoring system 50, wherein the control circuitry 210 can further comprise a second reset timeout circuitry 285 that can operationally reset into the ready state after the first communication 215 naturally terminates after the first selected time period then having a second selected clearing time period prior to placing the control circuitry 210 into the ready state to operationally prevent a subsequent second false alarm, see FIGS. 5 to 7, plus FIGS. 11, 12, and 17.

In looking at FIGS. 1 to 4 and 10 to 15, a first alternative embodiment for the HVAC monitoring system 50, that tests for an environmental abnormal condition 55 is disclosed, wherein the abnormal condition 60 results in effectuating a selected response from an HVAC building system 65 that includes an HVAC control circuit board 371, the HVAC monitoring system 50 including the sensor 200 for detecting the environmental abnormal condition 55, 60, wherein the first event marker signal 205 is generated from the sensor 200 detecting the environmental abnormal condition 55, 60.

Further included is the fuse module apparatus 370 that replaces an electrical power feed 395 fuse 390 to the HVAC control circuit board 371, the fuse module apparatus 370 is in electrical communication with a pair of electrical power feed fuse ports 395, 400 disposed on the HVAC control circuit board 371. The fuse module apparatus 370 includes a replacement fuse 390 for the power feed fuse 390 to the HVAC control circuit board 371, plus fuse module control circuitry 406 that is operative to monitor the first event marker signal 205 through the first communication 215 with the sensor 200.

Wherein the fuse module 370 control circuitry 406 is in a ready state that is operative to monitor for the first event marker signal 205, wherein the fuse module 370 control circuitry 406 outputs the second event marker signal 220 corresponding to the first event marker signal 205. In addition, the fuse module apparatus 370 includes a normally closed relay 440 in a second communication 230 with the fuse module control circuitry 406, the normally closed relay 440 is operative to be in an activated into an open operational state upon receiving the second event marker signal 220 to operationally shut down power to the HVAC control circuit board 371 to effectuate shutdown of the HVAC building system 65, see in particular FIGS. 13 to 15.

As an option for the first alternative embodiment of the HVAC monitoring system 50, the fuse module apparatus 370 can further comprise a first reset timeout 280 circuitry 415 that can operationally accommodate false alarms via the second event marker signal 220 being manually terminated within a first selected time period and placing the control circuitry 406 in the ready state. Further, the fuse module apparatus 370 can comprise a second reset timeout 285 circuitry 415 that can operationally reset into the ready state after the first communication 215 naturally terminates after the first selected time period then having a second selected clearing time period prior to placing the fuse module 370 control circuitry 406 into the ready state to operationally prevent a subsequent second false alarm, again see in particular FIGS. 13 to 15.

As another further option for the first alternative embodiment of the HVAC monitoring system 50, wherein the sensor 200 detecting the environment abnormal condition 55, 60 is selected from the group consisting of ambient temperature, smoke ionization, smoke optical, smoke photoelectric, catalytic combustible gas sensor for; natural gas, hydrogen, or propane, a carbon monoxide detector, or an ultraviolet infrared flame detector, see FIGS. 1 to 4, 7, 11, and 12.

An even further option for the HVAC monitoring system 50, wherein the sensor 200 is sized and configured to be disposed partially within a structural HVAC ductwork 235 and is constructed of the sensor 200 being mounted in a duct sidewall 250 with a sensor probe extension 255 disposed within a duct interior 260 and the sensor 200 including a housing 265 external to the duct interior 260 on an outside 270 of the duct sidewall 250, wherein operationally the sensor 200 monitors a duct interior 260 ambient environment 55, 60 to determine the environmental abnormal condition 55, 60, see FIGS. 1 to 4, 7, 11, and 12.

In looking at FIGS. 13 to 15, a second alternative embodiment of the HVAC monitoring system 50, is disclosed that tests for an environmental abnormal condition 55, 60, utilizing an existing sensor that outputs an available first event marker signal 205 when detecting the environmental abnormal condition 55, 60, wherein the environmental abnormal condition 55, 60 results in effectuating a selected response from an HVAC building system 65. The HVAC system includes an HVAC control circuit board 371, the HVAC monitoring system including the fuse module apparatus 370 that replaces an electrical power feed 395 fuse 390 to the HVAC control circuit board 371, the fuse module apparatus 370 is in electrical communication with a pair of electrical power feed fuse ports 395, 400 disposed on the HVAC control circuit board 371.

The fuse module apparatus 370 includes a replacement fuse 390 for the power feed fuse 390 to the HVAC control circuit board 371, plus fuse module control circuitry 406 that is operative to monitor said first event marker signal 205 through a first communication 215 with the sensor 200, wherein the fuse module 370 control circuitry 406 is in a ready state that is operative to monitor for the first event marker signal 205. Wherein the fuse module 370 control circuitry 406 outputs a second event marker signal 220 corresponding to the first event marker signal 205.

In addition, the fuse module apparatus 370 includes a normally closed relay 440 in a second communication 230 with the fuse module 370 control circuitry 406, the normally closed relay 440 is operative to be in an activated open operational state upon receiving the second event marker signal 220 to operationally shut down power to the HVAC control circuit board 371 to effectuate shutdown of the HVAC building system 65, see in particular FIGS. 13 to 15.

As an option for the second alternative embodiment of the HVAC monitoring system 50, the fuse module apparatus 370 can further comprise a first reset timeout 280 circuitry 415 that can operationally accommodate false alarms via said second event marker signal 220 being manually terminated within a first selected time period and placing the control circuitry 406 in the ready state. Further the fuse module apparatus 370 can further comprise a second reset timeout 285 circuitry 415 that can operationally reset into the ready state after the first communication 215 naturally terminates after the first selected time period then having a second selected clearing time period prior to placing the fuse module 370 control circuitry 406 into the ready state to operationally prevent a subsequent second false alarm, see in particular FIGS. 13 to 15.

Looking at FIGS. 1 to 4, 7, 10, 11, 12, and 16, a third alternative embodiment of the HVAC monitoring system 50, is disclosed that tests for an environmental abnormal condition 55, 60, wherein the abnormal condition 55, 60 results in effectuating a selected response from an HVAC building system 65, the HVAC monitoring system 50 including a sensor 200 for detecting the environmental abnormal condition 55, 60, wherein a first event marker signal 205 is generated from the sensor 200 detecting the environmental abnormal condition 55, 60.

Looking in particular at FIG. 16 for the third alternative embodiment of the HVAC monitoring system 50, the in-line hotwire relay module apparatus 600 is shown that includes an in-line hotwire relay module control circuitry 601 that is operative to monitor the first event marker signal 205 through a first communication 215 with the sensor 200, wherein the in-line hotwire relay module 600 control circuitry 601 is in a ready state that is operative to monitor for the first event marker signal 205.

Wherein the in-line hotwire relay module 600 control circuitry 601 outputs a second event marker signal 220 corresponding to the first event marker signal 205, in addition the in-line hotwire relay module apparatus 600 includes a normally closed relay 635 in a second communication 230 with the in-line hotwire relay module 600 control circuitry 601, the normally closed relay 635 is operative to be in an activated open operational state upon receiving the second event marker signal 220 to operationally shut down power 645 to the HVAC building system 65.

As an option for the third alternative embodiment of the HVAC monitoring system 50, wherein the in-line hotwire relay module apparatus 600 can further comprise a first reset timeout 280 circuitry 660 that can operationally accommodate false alarms via the second event marker signal 220 being manually terminated within a first selected time period and placing the in-line hotwire relay module 600 control circuitry 601 in the ready state.

Further the in-line hotwire relay module apparatus 600 can further comprise a second reset timeout 285 circuitry 660 that can operationally reset into the ready state after the first communication 215 naturally terminates after the first selected time period then having a second selected clearing time period prior to placing the in-line hotwire relay module 600 control circuitry 601 into the ready state to operationally prevent a subsequent second false alarm, see FIG. 16.

As an option for the third alternative embodiment of the HVAC monitoring system 50, wherein the sensor 200 detecting the environment abnormal condition 55, 60 is selected from the group consisting of ambient temperature, smoke ionization, smoke optical, smoke photoelectric, catalytic combustible gas sensor for; natural gas, hydrogen, or propane, a carbon monoxide detector, or an ultraviolet infrared flame detector, see FIGS. 1 to 4, 7, 11, and 12.

As a further option for the third alternative embodiment of the HVAC monitoring system 50, wherein the sensor 200 is sized and configured to be disposed partially within a structural HVAC ductwork 235 and is constructed of the sensor 200 being mounted in a duct sidewall 250 with a sensor probe extension 255 disposed within a duct interior 260 and the sensor 200 including a housing external 265 to the duct interior 260 on an outside 270 of the duct sidewall 250, wherein operationally the sensor 200 monitors a duct interior ambient environment 55, 60 to determine the environmental abnormal condition 55, 60, see FIGS. 1 to 4, 7, 11, and 12.

CONCLUSION

Accordingly, the present invention of an HVAC monitoring system has been described with some degree of particularity directed to the embodiments of the present invention. It should be appreciated, though, that the present invention is defined by the following claims construed in light of the prior art so modifications or changes may be made to the exemplary embodiments of the present invention without departing from the inventive concepts contained therein.

The invention claimed is:

1. An HVAC monitoring system that tests for an environmental abnormal condition, wherein the environmental abnormal condition effectuates a selected response from an HVAC building system that includes an HVAC control circuit board, said HVAC monitoring system comprising:

(a) a sensor for detecting the environmental abnormal condition, wherein a first event marker signal is generated from said sensor detecting the environmental abnormal condition; and (b) a fuse module apparatus that replaces an electrical power feed fuse to the HVAC control circuit board, said fuse module apparatus is in electrical communication with a pair of electrical power feed fuse ports disposed on the HVAC control circuit board, said fuse module apparatus includes a replacement fuse for the power feed fuse to the HVAC control circuit board, said fuse module apparatus also includes a fuse module control circuitry that is operative to monitor said first event marker signal through a first communication with said sensor, wherein said fuse module control circuitry is in a ready state that is operative to monitor for said first event marker signal, wherein said fuse module control circuitry outputs a second event marker signal corresponding to said first event marker signal, in addition said fuse module apparatus includes a normally closed relay in a second communication with said fuse module control circuitry, said normally closed relay is operative to be in an activated open operational state upon receiving said second event marker signal to operationally shut down power to the HVAC control circuit board to effectuate shutdown of the HVAC building system, said fuse module apparatus further comprises a first reset timeout circuitry that operationally accommodates false alarms via said second event marker signal being manually terminated within a first selected time period and placing said control circuitry in said ready state, further said fuse module apparatus further comprises a second reset timeout circuitry that operationally resets into said ready state after the first communication naturally terminates after said first selected time period then having a second selected clearing time period prior to placing said fuse module control circuitry into said ready state to operationally prevent a subsequent second false alarm.

2. The HVAC monitoring system according to claim 1 wherein said sensor detecting the environment abnormal condition is selected from the group consisting of ambient temperature, smoke ionization, smoke optical, smoke photoelectric, catalytic combustible gas sensor for; natural gas, hydrogen, or propane, a carbon monoxide detector, or an ultraviolet infrared flame detector.

3. The HVAC monitoring system according to claim 2 wherein said sensor is sized and configured to be disposed partially within a structural ductwork and is constructed of said sensor being mounted in a duct sidewall with a sensor probe extension disposed within a duct interior and said sensor including a housing external to said duct interior on an outside of the duct sidewall, wherein operationally said sensor monitors a duct interior ambient environment to determine the environmental abnormal condition.

4. An HVAC monitoring system that tests for an environmental abnormal condition, utilizing an existing sensor that outputs an available first event marker signal when detecting the environmental abnormal condition, wherein the environmental abnormal condition effectuates a selected response from an HVAC building system that includes an HVAC control circuit board, said HVAC monitoring system comprising:

(a) a fuse module apparatus that replaces an electrical power feed fuse to the HVAC control circuit board, said fuse module apparatus is in electrical communication with a pair of electrical power feed fuse ports disposed on the HVAC control circuit board, said fuse module apparatus includes a replacement fuse for the power feed fuse to the HVAC control circuit board, said fuse module apparatus also includes a fuse module control circuitry that is operative to monitor said first event marker signal through a first communication with the sensor, wherein said fuse module control circuitry is in a ready state that is operative to monitor for said first event marker signal, wherein said fuse module control circuitry outputs a second event marker signal corresponding to said first event marker signal, in addition said fuse module apparatus includes a normally closed relay in a second communication with said fuse module control circuitry, said normally closed relay is operative to be in an activated open operational state upon receiving said second event marker signal to operationally shut down power to the HVAC control circuit board to effectuate shutdown of the HVAC building system, said fuse module apparatus further comprises a first reset timeout circuitry that operationally accommodates false alarms via said second event marker signal being manually terminated within a first selected time period and placing said control circuitry in said ready state further said fuse module apparatus further comprises a second reset timeout circuitry that operationally resets into said ready state after the first communication naturally terminates after said first selected time period then having a second selected clearing time period prior to placing said fuse module control circuitry into said ready state to operationally prevent a subsequent second false alarm.

5. An HVAC monitoring system that tests for an environmental abnormal condition, wherein the environmental abnormal condition effectuates a selected response from an HVAC building system, said HVAC monitoring system comprising:

(a) a sensor for detecting the environmental abnormal condition, wherein a first event marker signal is generated from said sensor detecting the environmental abnormal condition; and (b) an in-line hotwire relay module apparatus that includes an in-line hotwire relay module control circuitry that is operative to monitor said first event marker signal through a first communication with said sensor, wherein said in-line hotwire relay module control circuitry is in a ready state that is operative to monitor for said first event marker signal, wherein said in-line hotwire relay module control circuitry outputs a second event marker signal corresponding to said first event marker signal, in addition said in-line hotwire relay module apparatus includes a normally closed relay in a second communication with said in-line hotwire relay module control circuitry, said normally closed relay is operative to be in an activated open operational state upon receiving said second event marker signal to operationally shut down power to the HVAC building system, said in-line hotwire relay module apparatus further comprises a first reset timeout circuitry that operationally accommodates false alarms via said second event marker signal being manually terminated within a first selected time period and placing said in-line hotwire relay module control circuitry in said ready state, further said in-line hotwire relay module apparatus further comprises a second reset timeout circuitry that operationally resets into said ready state after the first communication naturally terminates after said first selected time period then having a second selected clearing time period prior to placing said in-line hotwire relay module control circuitry into said ready state to operationally prevent a subsequent second false alarm.

6. The HVAC monitoring system according to claim 5 wherein said sensor detecting the environment abnormal condition is selected from the group consisting of ambient temperature, smoke ionization, smoke optical, smoke photoelectric, catalytic combustible gas sensor for; natural gas, hydrogen, or propane, a carbon monoxide detector, or an ultraviolet infrared flame detector.

7. The HVAC monitoring system according to claim 6 wherein said sensor is sized and configured to be disposed partially within a structural ductwork and is constructed of said sensor being mounted in a duct sidewall with a sensor probe extension disposed within a duct interior and said sensor including a housing external to said duct interior on an outside of the duct sidewall, wherein operationally said sensor monitors a duct interior ambient environment to determine the environmental abnormal condition.

* * * * *